US006914994B1

(12) United States Patent
Shennib et al.

(10) Patent No.: US 6,914,994 B1
(45) Date of Patent: Jul. 5, 2005

(54) CANAL HEARING DEVICE WITH TRANSPARENT MODE

(75) Inventors: Adnan Shennib, Danville, CA (US); Ross G. Baker, Jr., Bellaire, TX (US)

(73) Assignee: InSound Medical, Inc., Newark, CA (US)

( * ) Notice: Subject to any disclaimer, the term of this patent is extended or adjusted under 35 U.S.C. 154(b) by 405 days.

(21) Appl. No.: 09/949,158

(22) Filed: Sep. 7, 2001

(51) Int. Cl.[7] ..... H04R 25/00
(52) U.S. Cl. ..... 381/312; 381/315; 381/321
(58) Field of Search ..... 381/312, 314, 381/317, 318, 320, 321, 323, 315

(56) References Cited

U.S. PATENT DOCUMENTS

| | | | | |
|---|---|---|---|---|
| 3,594,514 | A | | 7/1971 | Wingrove |
| 3,764,748 | A | | 10/1973 | Branch et al. |
| 3,870,832 | A | | 3/1975 | Fredrickson |
| 3,882,285 | A | | 5/1975 | Nunley et al. |
| 4,505,329 | A | | 8/1986 | Hough |
| 4,628,907 | A | | 12/1986 | Epley |
| 4,756,312 | A | | 7/1988 | Epley |
| 4,776,322 | A | | 10/1988 | Hough et al. |
| 4,817,607 | A | | 4/1989 | Tatge |
| 4,840,178 | A | | 6/1989 | Heide et al. |
| 4,955,729 | A | * | 9/1990 | Marx ..... 381/322 |
| 4,957,478 | A | | 9/1990 | Maniglia |
| 5,015,225 | A | | 4/1991 | Hough et al. |
| 5,015,224 | A | | 5/1991 | Maniglia |
| 5,163,957 | A | | 11/1992 | Sade et al. |
| 5,220,918 | A | | 6/1993 | Heide et al. |
| 5,259,032 | A | | 11/1993 | Perkins et al. |
| 5,282,858 | A | | 2/1994 | Bisch et al. |
| 5,338,287 | A | | 8/1994 | Miller et al. |
| 5,425,104 | A | | 6/1995 | Shennib |
| 5,456,654 | A | | 10/1995 | Ball |
| 5,531,787 | A | | 7/1996 | Lesinski et al. |
| 5,554,096 | A | | 9/1996 | Ball |
| 5,624,376 | A | | 4/1997 | Ball et al. |
| 5,654,530 | A | | 8/1997 | Sauer et al. |
| 5,682,020 | A | | 10/1997 | Oliveira |
| 5,701,348 | A | | 12/1997 | Shennib et al. |
| 5,833,626 | A | | 11/1998 | Leysieffer |
| 6,118,878 | A | * | 9/2000 | Jones ..... 381/72 |
| 6,128,392 | A | * | 10/2000 | Leysieffer et al. ..... 381/318 |
| 6,130,950 | A | * | 10/2000 | Martin ..... 381/312 |
| 6,408,081 | B1 | | 6/2002 | Boesen |
| 6,516,073 | B1 | * | 2/2003 | Schulz et al. ..... 381/312 |
| 6,620,110 | B2 | | 9/2003 | Schmid |
| 6,643,378 | B2 | | 11/2003 | Schumaier |
| 6,648,813 | B2 | | 11/2003 | Zilberman et al. |
| 6,658,126 | B1 | | 12/2003 | Stern |

OTHER PUBLICATIONS

US 5,730,699, 3/1998, Adams et al. (withdrawn)

* cited by examiner

*Primary Examiner*—Suhan Ni
(74) *Attorney, Agent, or Firm*—Townsend and Townsend and Crew LLP

(57) ABSTRACT

The invention provides a canal hearing device and method in which the device is implemented with a mode of operation that provides acoustic transparency as well as a power-saving function, particularly useful to permit the user to wear the device in the ear canal during periods of sleep or inactivity without substantial loss of normal unaided response. The transparent mode has an in-situ acoustic transfer function that compensates for the insertion loss caused by the presence of a hearing device in the ear canal. While the device is in this transparent mode, its acoustic transfer function gives the user a perception of unaided hearing, as though the device were removed, when it is actually being worn continuously in the ear canal. Current drain of the device is significantly reduced as the transparent mode serves to shut off or reduce bias currents of at least one circuit element within the device circuitry. The invention is particularly useful in canal hearing devices adapted for extended wear in the ear canal for periods longer than one month without removal.

22 Claims, 3 Drawing Sheets

CANAL HEARING DEVICE WITH TRANSPARENT MODE

BACKGROUND OF THE INVENTION

1. Technical Field

The present invention relates generally to miniature hearing aids, acoustic and otherwise, which are fitted deeply in the ear canal.

2. Description of the Prior Art

Conventional hearing aids provide sound amplification selected based on individual hearing loss. It is well known in the field of hearing aids that turning such devices OFF while being worn in the ear causes additional hearing loss to the wearer. This loss, referred to sometimes as "insertion loss", occurs due to the occlusion of the ear canal by the hearing device. This occlusion prevents sounds from reaching the eardrum directly via the ear canal (see e.g., Sandlin, *Hearing Instrument Science & Fitting Practices*, National Institute for Hearing Instruments Studies, 1996, pp. 358).

It is also well known in the field of hearing aids that the unoccluded (open) ear canal (1 in FIG. 1) contributes significantly to the acoustic modification which occurs when sound (2) travels to the eardrum (4). This transfer function, sometimes referred to as Real-Ear Unaided Response (REUR) which includes the canal resonance, provides acoustic amplification at certain frequencies, generally in the range of 2000 to 4000 kHz (see e.g., Chasin M., *Completely In The Canal Handbook*, Singular Publishing, 1997, pp. 91). However, the occlusion by an in-situ hearing device in the OFF condition dramatically alters both the quality of incoming sound (altered frequency response—muffled) as well as its quantity (attenuation).

For the above reasons, a hearing aid is typically either worn with amplification ON, or removed from the ear and turned OFF for conserving battery power. It is conceivable that a hearing device may be worn OFF for achieving sound attenuation with the device acting essentially as an earplug. However, this is clearly not a desirable scenario for the hearing impaired who already suffer from hearing loss and cannot afford the additional loss. An acoustic vent across a hearing device is typically employed in conventional aids for variety of reasons including allowing certain frequency ranges to bypass the device and reach the eardrum via the vent. However, venting is useful mainly in conjunction with amplification provided by the ON in-situ device. Hence, vents do not substitute for the natural unaided response when an in-situ device is in the OFF condition.

More practical means of reducing current consumption, without resorting to shutting of the device, include volume reduction. However, volume reduction does not reduce power consumption proportional to the reduction nor does it restore the natural perception of unaided hearing.

Reducing the power consumption has always been a major goal in hearing aid design. In programmable hearing aids, for example, circuit elements can be selectively turned off depending on the operating condition required by the user. Martin et. al. for example, in U.S. Pat. No. 5,710,820 describe a hearing aid in which "function blocks not required for the selected operating condition are deactivated and bridged (cut out), so that only the current respectively required for the active function blocks is drawn from the battery 35."

Recent advances have lead to the development of extended-wear (semi-permanent) canal hearing devices, which are operated continuously in the ear canal for several months before battery depletion and removal. These canal hearing devices are totally inconspicuous thus cosmetically appealing to the users. Turning these extended-wear devices OFF during sleep or inactivity is desirable on one hand for reducing power consumption and extending the battery life of the device. However, turning these devices OFF in-situ causes an insertion loss as described above. The insertion loss is problematic for these users since it further limits their hearing ability , particularly in emergency situations (fire alarm, horn blowing, traffic sounds, etc.). Another problem caused by the insertion loss of hearing aids in general is the inability to hear sounds naturally in a similar manner as in the unaided condition. Removal of the extended-wear devices to restore unaided hearing contradicts the intended purpose of their continuous wear.

A key goal of the present invention is to provide a canal device and a method thereof for reproducing the unaided response while the hearing device is worn in the ear canal.

Another goal of the present invention is to significantly reduce the power consumption of a canal hearing device in-situ while simultaneously producing the experience of unaided hearing.

SUMMARY OF THE INVENTION

The device and method of the present invention provide a power-saving mode of operation offering acoustic transparency, particularly suited for canal hearing devices during sleep or inactivity. Acoustic transparency is accomplished by providing an in-situ acoustic transfer function that compensates for the insertion loss caused by the presence of a hearing device in the ear canal. The transparent mode simulates the user's experience of unaided hearing, thus causing the user to perceive the acoustic "absence" of a hearing device while a device is worn in the ear canal. This mode also significantly reduces current drain from the battery for extending the life of the hearing device. Current reduction is achieved by shutting off one or more circuit elements and by reducing bias currents to other elements.

The invention essentially reproduces the unaided hearing function while providing significant power savings without resorting to removing the device from the ear canal. It allows the user to continue to hear and respond to emergency situations as if the device were not present in the ear canal. The invention is particularly applicable for extended wear applications in which a specialized hearing device is worn continuously in the ear canal for several months without daily removal. The invention is also applicable for disposable hearing devices wherein the longevity of the integrated battery is desirable for the user.

BRIEF DESCRIPTION OF THE DRAWINGS

The above and still further goals, objectives, features, aspects and attendant advantages of the present invention will be better understood from the following detailed description of the best mode presently contemplated for practicing the invention, with reference to certain preferred embodiments and methods, taken in conjunction with the accompanying Figures of drawing, in which.

DETAILED DESCRIPTION OF THE PREFERRED EMBODIMENTS AND METHODS

Figure 2:
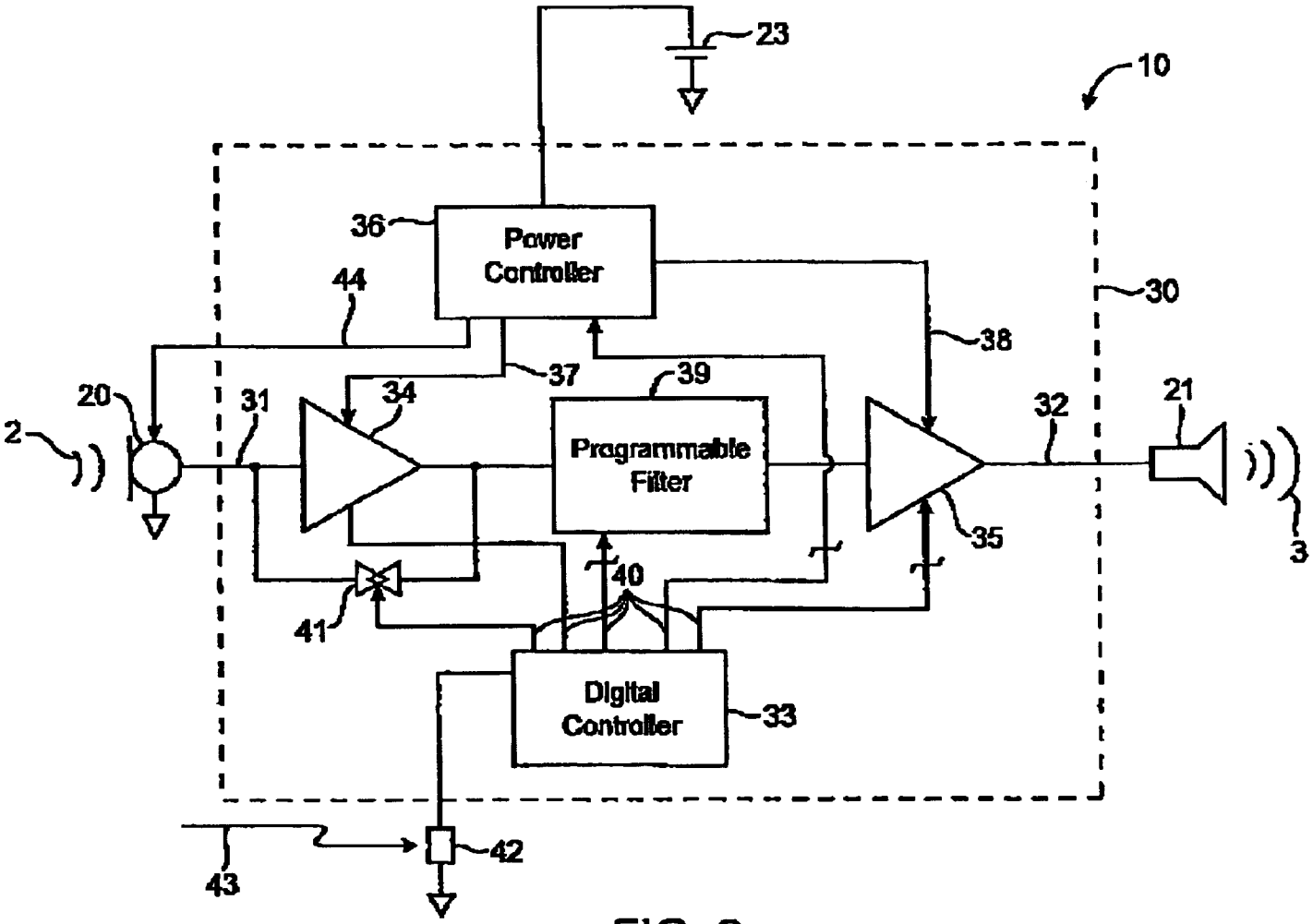
FIG. 2 is a schematic diagram of an analog amplifier embodiment of the hearing device of the present invention.
Figure 3:
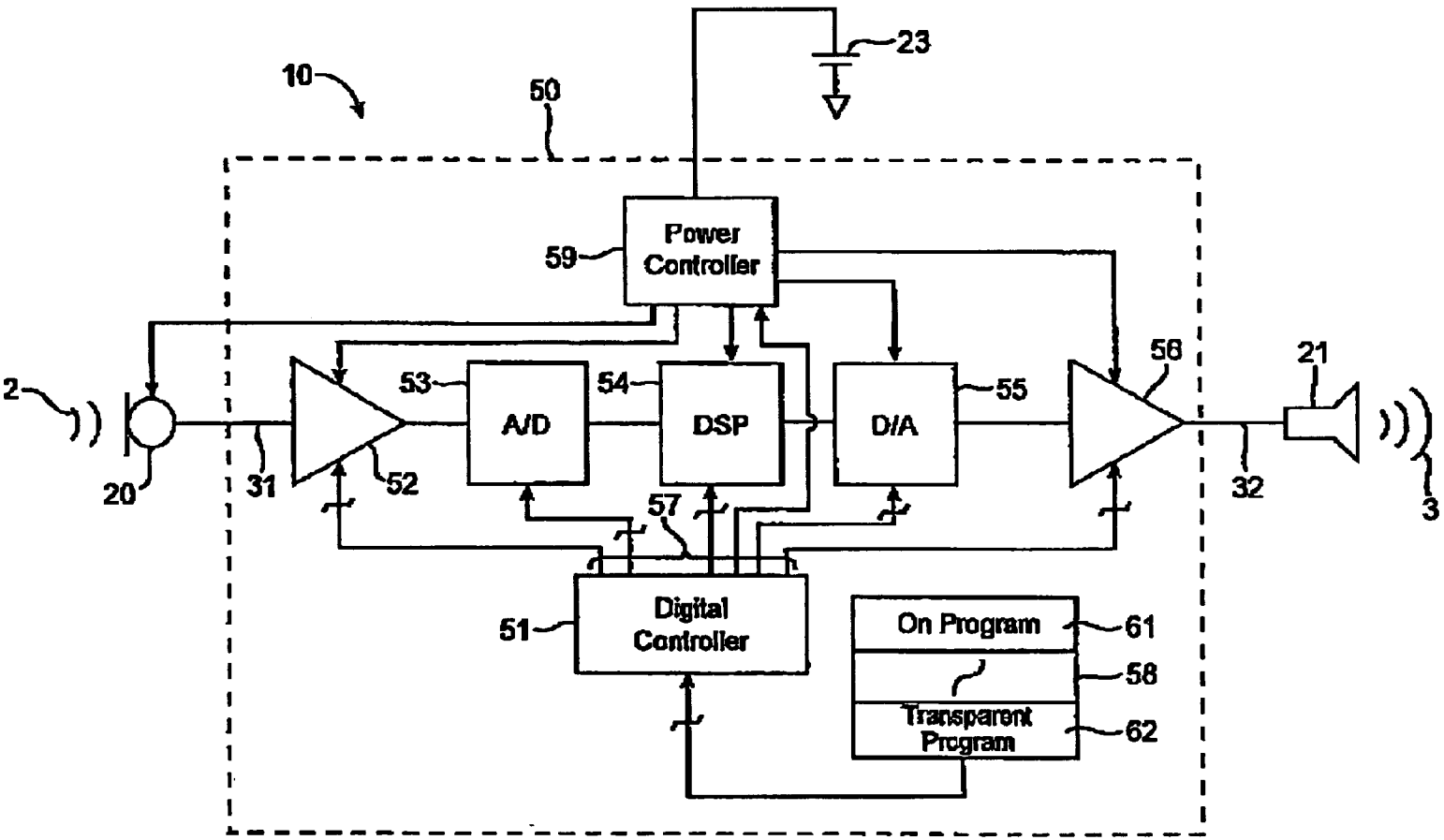
FIG. 3 is a schematic diagram of digital-signal-processing embodiment of the invented hearing device.

The present invention, illustrated in FIGS. 2 and 3, provides hearing enhancement device 10 placed in the ear canal 1. The invented device and method thereof provide acoustic transparency by providing in-situ acoustic transfer function that compensates for the insertion loss caused by the presence of a hearing device in the ear canal. The transparent mode simulates the user's experience of unaided hearing, thus causing the user to perceive the "absence" of a hearing device while a device is worn in the ear canal. This mode is particularly useful during wearer inactivity, such as during sleeping, thus referred to below sometimes as sleep mode.

The transparent mode significantly reduces current drain from the battery for extending the life of the hearing device. Current reduction is achieved by shutting off one or more circuit elements and/or by reducing bias currents to other elements. The invention essentially restores the unaided hearing function while providing significant power savings, all without resorting to removing the device from the ear canal.

In the exemplary embodiments shown in FIGS. 2 and 3 (and with further reference to FIG. 1), the canal hearing device 10 comprises a microphone 20, a receiver (speaker) 21, battery 23, and integrated circuitry 30 (50 in FIG. 3). The microphone picks up incoming sound 2 and receiver 21 delivers amplified sound 3 to the eardrum 4.

In the analog embodiment of FIG. 2, integrated circuit 30 comprises circuit elements including input amplifier 34 and output amplifier 35, for amplifying microphone output 31 and producing amplified receiver input 32. Amplifiers 34 and 35 are biased via bias lines 37 and 38, respectively, from current sources within power controller circuit 36. Digital controller 33 provides control signals 40 to input amplifier 34, output amplifier 35, programmable filter 39, and power controller circuit 36. The amplification and filter settings are programmed into digital controller 33 by means well known in the field of hearing aid design. This includes wire and wireless programming methods which load a program setting (prescription) into memory elements (not shown) associated with digital controller 33. The programming of the embodiment of FIG. 2 is accomplished via a magnetic switch 42 activated by an external magnetic field 43 produced by a magnet held by the user, for example. The user, using a magnet or other programming methods known in the field, selects the transparent mode or other modes such as ON or OFF, as desired. The prescription is selected according to specific amplification and filtering needs of the hearing impaired individual.

In the normal ON operation, bias currents from bias lines 37 and 38 are relatively high. This is due to the relatively high amplification (gain) requirement of the hearing device 10. However, when the digital controller 33 is appropriately invoked by the user, the control signals 40 are switched to reflect the transparency mode. This causes the power controller to reduce bias currents substantially since the gain requirements are relatively lower than ON gain requirements. Furthermore, input amplifier 34 is preferably completely shut off (zero bias current from bias line 37) during the transparency mode in the embodiment of FIG. 2. In this case, the microphone output 31 is switched directly to programmable filter 39 input via analog switch 41. Bias current to the microphone 20 via microphone bias line 44 is also reduced during sleep mode of the present invention.

FIG. 3 illustrates a digital signal processing embodiment of the invented hearing device 10 comprising microphone 20, receiver 21, battery 23 and integrated circuit 50. In this embodiment, digital controller 51 defines the settings for circuit blocks via control lines 57 connected to pre-amplifier 52, analog-to-digital (A/D) converter 53, digital signal processor (DSP) unit 54, digital-to-analog (D/A) converter 55 and output amplifier 56. Memory element 58 comprises various prescriptions, individualized or generalized, such as ON Program 61 and Transparent Program 62 for on and sleep modes, respectively. The digital controller 51 also controls the power controller 59 to affect bias currents of circuit blocks depending on the desired mode of operation.

In each of these embodiments, the sleep (transparent) mode of the device is preset to produce an in-situ response substantially similar to the unaided response (i.e., mirroring the response that would be perceived by the hearing of the impaired individual if no hearing device were present in the ear canal). Thus, the wearer receives the benefit of being able to leave the device in place in the ear, without experiencing the occlusion that would otherwise be present if the transparent mode of the invention were not provided in the hearing device.

The transparent mode is particularly desirable for extended wear canal hearing devices, which are worn continuously in the ear canal for several months without daily removal. Since the user does not remove the device from the ear on a daily basis, as he or she would with conventional hearing aids, the transparent mode allows the user to perceive sounds as though they were "unaided," and allows the device to conserve energy to enable extended wear. The transparency mode is most suitable during sleep and resting, since it is during those times that users of conventional hearing aids generally prefer to remove the device from the ear to avoid prolonged and unnecessary amplification, and consequent noise-induced fatigue and irritation. Turning an in-situ device OFF for extended wear applications causes insertion loss which interferes with communications and further presents a potential hazard during emergency situations (i.e., fire alarm, traffic, etc.).

Figure 1:
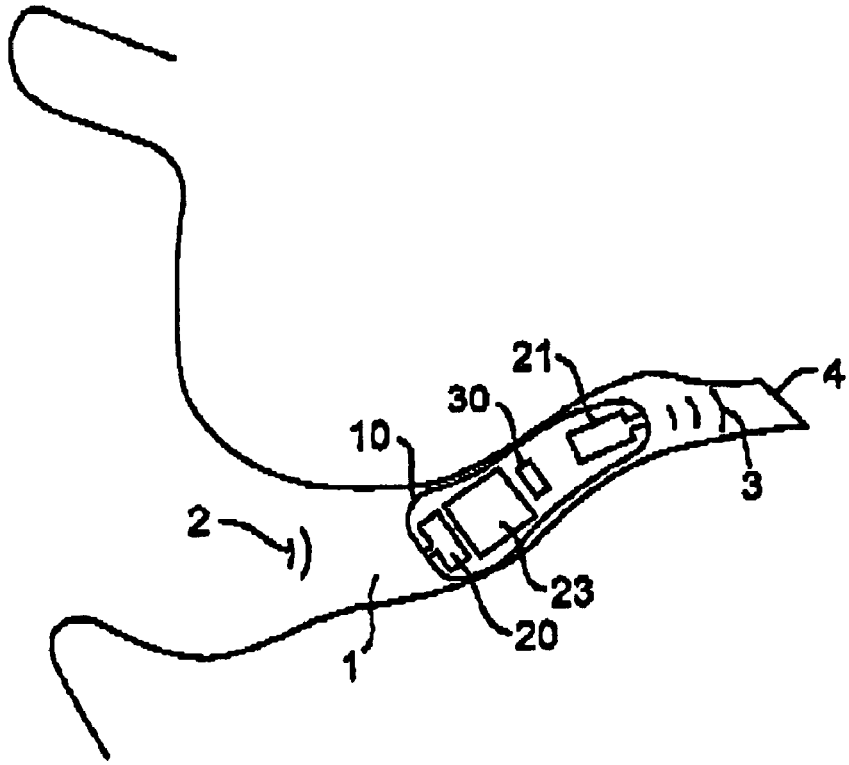
FIG. 1 is a view of the ear canal occluded with a deep canal hearing device.

In the preferred embodiments of the present invention as described above, however, the aided response in the transparent mode is adjusted or preset to yield an overall response in-situ substantially similar to the unaided response. In those embodiments, the aided response in the sleep mode is within 6 decibels (db) of the unaided response, particularly in the range of 125 to 4,000 Hertz (Hz). The prescription of the device depends on the position of the device in the ear canal, and particularly the distance and air volume between the receiver 21 and eardrum 4 (FIG. 1). For a particular hearing device, the sleep mode prescription may be generic, based on a generalized ear model; or it may be specific, based on measured unaided and aided responses.

The transparent mode is also applicable for other types of hearing devices such as disposable hearing aids with integrated battery. In such applications, the hearing device is disposed of when its integrated battery is depleted. The transparent mode improves the longevity of the disposable device, thus reducing the cost of replacement over time. Extended wear canal devices with alternate transducers, such as direct tympanic drive (e.g., see U.S. Pat. No. 6,137,889), are equally suited to benefit from the transparent mode of the present intention.

Five prototypes of canal hearing devices currently under development by InSonus Medical Inc. (assignee of the present invention) were evaluated in terms of current consumption during various modes of operation; namely Full-ON-Gain (FOG) mode, typical ON mode, and transparent mode. FOG mode represents the maximum gain settings available for the device. Typical ON mode represents typical gain settings for the average user, and transparent mode represents a setting offering functional gain generally within 6 decibels of unaided response in the standard audiometric frequency range. The transparent mode causes the hearing device to reduce bias currents to the microphone 20 (FIG. 2) and output amplifier 35. Furthermore, bias current is essentially shut off for input amplifier 34 while the microphone output 31 is switched directly to the input of output amplifier 35. These reductions lead to substantial current savings in the transparent mode as is shown below.

Each of the canal device prototypes comprises a proprietary ultra-low power integrated circuit 30 (model DS-I) according to the embodiment of FIG. 2. The device prototypes were tested using standard hearing aid analyzer equipment (model Fonix 6500 CX manufactured by Frey Electronic) and a standard CIC (Completely-In-the-Canal) coupler simulating the ear canal cavity. The current consumption was measured using a laboratory digital meter (model PROTEK 506).

The current consumption in the FOG, ON and transparent modes was 65.9 microamperes ($\mu$A), 40.3 $\mu$A and 5.8 $\mu$A, respectively, on average for the five prototypes.

The transparent mode reduces power consumption by approximately 91% of maximum settings and by 85% of typical settings.

Although a presently preferred best mode of practicing the invention has been described herein, with reference to certain exemplary embodiments and methods, it will be apparent to those skilled in the art to which the invention pertains, that variations and modifications of the disclosed embodiments and methods may be implemented without departing from the spirit and scope of the invention. It is therefore intended that the invention shall be limited only to the extent required by the appended claims and the rules and principles of the applicable law.

What is claimed is:

1. In a canal hearing device for hearing enhancement to a user, which includes a microphone, a receiver, an amplifier means for amplifying sound signals picked up by said microphone to be input to said receiver; and a power source for supplying electrical power to said device; the improvement comprising:

means for selectively invoking an acoustic transparent mode of operation of said device including a controller responsive to invocation of said acoustic transparent mode for reducing power consumption of said device in a manner to provide simulation of substantially unoccluded hearing without acoustic insertion loss to the user despite presence of said device in the user's ear canal.

2. The improvement of claim 1, wherein said reduced power consumption is attributable to said controller selectively reducing current drain of said device.

3. The improvement of claim 2, wherein:

said controller selectively reducing current drain reduces at least one bias current of a circuit element within said device.

4. The improvement of claim 2, wherein:

said controller selectively reducing current drain shuts off at least a portion of said amplifier means.

5. The improvement of claim 1, wherein:

said simulation of substantially unoccluded hearing without acoustic insertion loss is within approximately 6 decibels of unaided hearing.

6. The improvement of claim 1, wherein:

said means for selectively invoking said acoustic transparent mode is selectable by said user.

7. The improvement of claim 1, wherein:

said canal hearing device is an extended-wear device adapted to be worn continuously in the ear canal for longer than one month.

8. The improvement of claim 1, wherein:

said power source is a battery, and said canal hearing device is disposable, adapted to be discarded when said battery is depleted.

9. A canal hearing device for hearing enhancement, said hearing device causing an acoustic insertion loss when placed in the ear canal of a wearer in an OFF condition and normally producing an acoustic gain substantially greater than said insertion loss when powered in an ON condition, said hearing device comprising:

a microphone, circuitry for processing sound signals detected by said microphone, and a power source; and acoustic transparency means for selectively initiating an in-situ acoustic transfer function within said device substantially compensating for said acoustic insertion loss to create an acoustic perception to the wearer of said device of substantially unaided hearing response despite continued presence of said hearing device in the ear canal.

10. The canal hearing device of claim 9, wherein:

said acoustic transparency means initiates an in-situ acoustic transfer function of aided response by said device within about 6 decibels of unaided response.

11. The canal hearing device of claim 9, wherein said acoustic transparency means selectively initiates said in-situ acoustic transfer function by reducing at least one bias current of a circuit element within said circuitry.

12. The canal hearing device of claim 9, wherein said acoustic transparency means selectively initiates said in-situ acoustic transfer function by shutting off at least one amplifier within said circuitry.

13. The canal hearing device of claim 9, wherein said in-situ acoustic transfer function is programmable to accommodate the individual wearer.

14. The canal hearing device of claim 9, wherein said canal hearing device is an extended-wear device adapted to be worn continuously in the ear canal for at least one month.

15. The canal hearing device of claim 9, wherein said power source is a battery, and said canal hearing device is disposable, adapted to be discarded when said battery is depleted.

16. A method of rendering a canal hearing device acoustically transparent in use, wherein said canal hearing device comprises a microphone, circuitry and a power source, and normally produces an acoustic insertion loss while powered OFF when in the ear canal of a user and an acoustic gain substantially greater than said insertion loss when powered ON, said method comprising the steps of:

implementing said canal hearing device with a selectable acoustic transparency mode of operation that produces an in-situ acoustic transfer function to compensate for said acoustic insertion loss, and thereby simulate to the user an absence of said canal hearing device despite its continued presence in the ear canal, and providing said canal hearing device with means to enable the user to select said acoustic transparency mode of operation.

17. The method of claim 16, including implementing said acoustic transparency mode to produce said in-situ acoustic transfer function for an aided response within about 6 decibels of an unaided response to the user.

18. The method of claim 16, including rendering said acoustic transparency mode to be programmable so that its in-situ acoustic transfer function may be programmed to accommodate the individual user.

19. The method of claim 16, including implementing said acoustic transparency mode to reduce bias current for at least one amplifier within said circuitry.

20. The method of claim 16, including implementing said acoustic transparency mode to shut off at least one amplifier within said circuitry.

21. The method of claim 16, including adapting said canal hearing device for extended wear continuously in the ear canal for a period of time of at least one month.

22. The method of claim 16, including fabricating said canal hearing device with sufficiently inexpensive components to render it disposable when its power source is depleted.

* * * * *